United States Patent [19]

Shank et al.

[11] 4,299,097

[45] Nov. 10, 1981

[54] VANE TYPE COMPRESSOR EMPLOYING ELLIPTICAL-CIRCULAR PROFILE

[75] Inventors: Wayne C. Shank, Tucson, Ariz.; Thomas C. Edwards, Cocoa Beach, Fla.

[73] Assignee: The Rovac Corporation, Rockledge, Fla.

[21] Appl. No.: 157,564

[22] Filed: Jun. 16, 1980

[51] Int. Cl.[3] ..... F03C 2/00; F25B 1/00

[52] U.S. Cl. ..... 62/229; 418/150; 418/159

[58] Field of Search ..... 418/150, 259, 159, 15; 62/229

[56] References Cited

U.S. PATENT DOCUMENTS

| | | | |
|---|---|---|---|
| 475,301 | 5/1892 | Crowell | 418/150 |
| 3,286,913 | 11/1966 | Kaatz et al. | 418/150 |
| 3,334,546 | 8/1967 | Vuolle-Apiala | 418/159 |

FOREIGN PATENT DOCUMENTS

| | | | |
|---|---|---|---|
| 2725238 | 12/1977 | Fed. Rep. of Germany | 418/259 |

*Primary Examiner*—William E. Wayner

*Attorney, Agent, or Firm*—Leydig, Voit, Osann, Mayer & Holt, Ltd.

[57] ABSTRACT

A rotary compressor for use in air conditioning or the like including a housing having a chamber with a cylindrical rotor journaled therein, the rotor having a set of vanes radially slidable to define enclosed compartments between them. The curved outer wall of chamber has a reference region separating the chamber into inlet and outlet sides having inlet and outlet ports in straddling relation. The rotor has its axis laterally offset from the chamber axis to produce sealing at the reference region. The curved wall of the chamber on the inlet side is of substantially elliptical profile with the major axis of the ellipse generally centered on the inlet side and with the inlet port extending to a point of cut-off short of the major axis. The curved wall on the outlet side is smoothly continuous and substantially circular in profile. In operation, gas entering the inlet port is charged in a compartment between a pair of vanes at the major elliptical axis and progressively compressed over an arc of compression greater than about 180 degrees for discharge from the outlet port in the compressed state. The outlet port is provided with a circular liner the trailing end of which defines the point of initial discharge from the outlet port, the liner being peripherally shiftable to vary the pressure at which the gas is discharged.

5 Claims, 8 Drawing Figures

20
21
23
23a
24
24a
25
31
32
33
34
35
37
38
39
40
41
42
54
59
64
69
1.
5.

20
21
23a
25
26
27
28
35
39
40
51
52
53
54
55
56
57
58
59
60
61
62
63
64
65
66
67
68
69
70
71
72
73
74
75
115
116
2.

FIG. 3
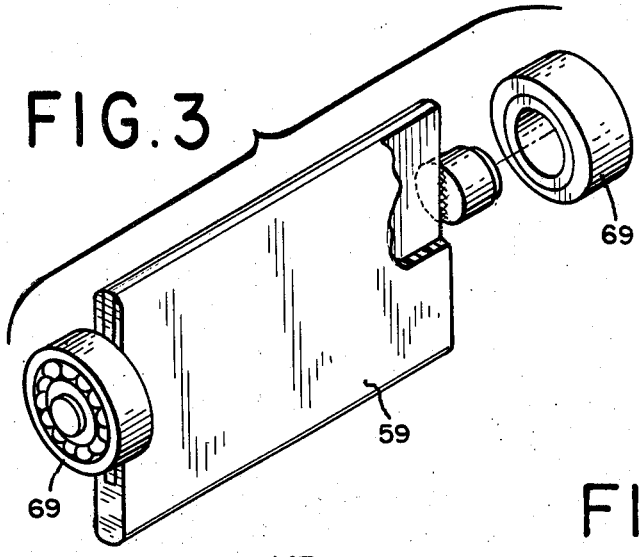
FIG. 8
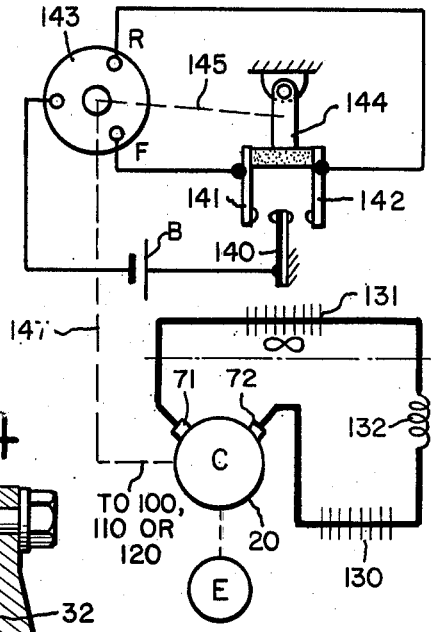
FIG. 4
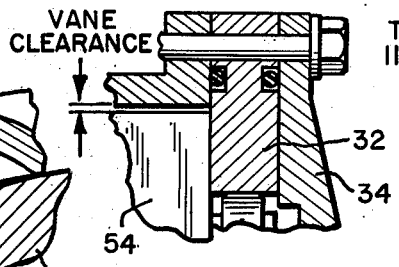
FIG. 7
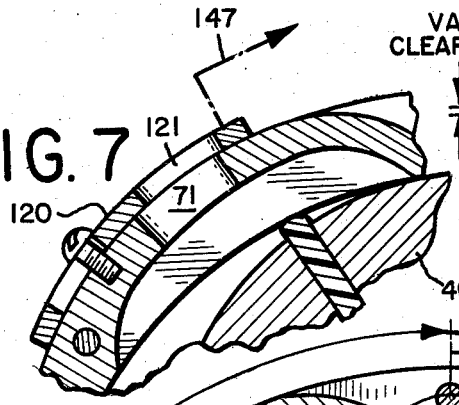
FIG. 6
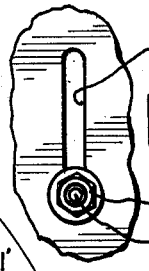
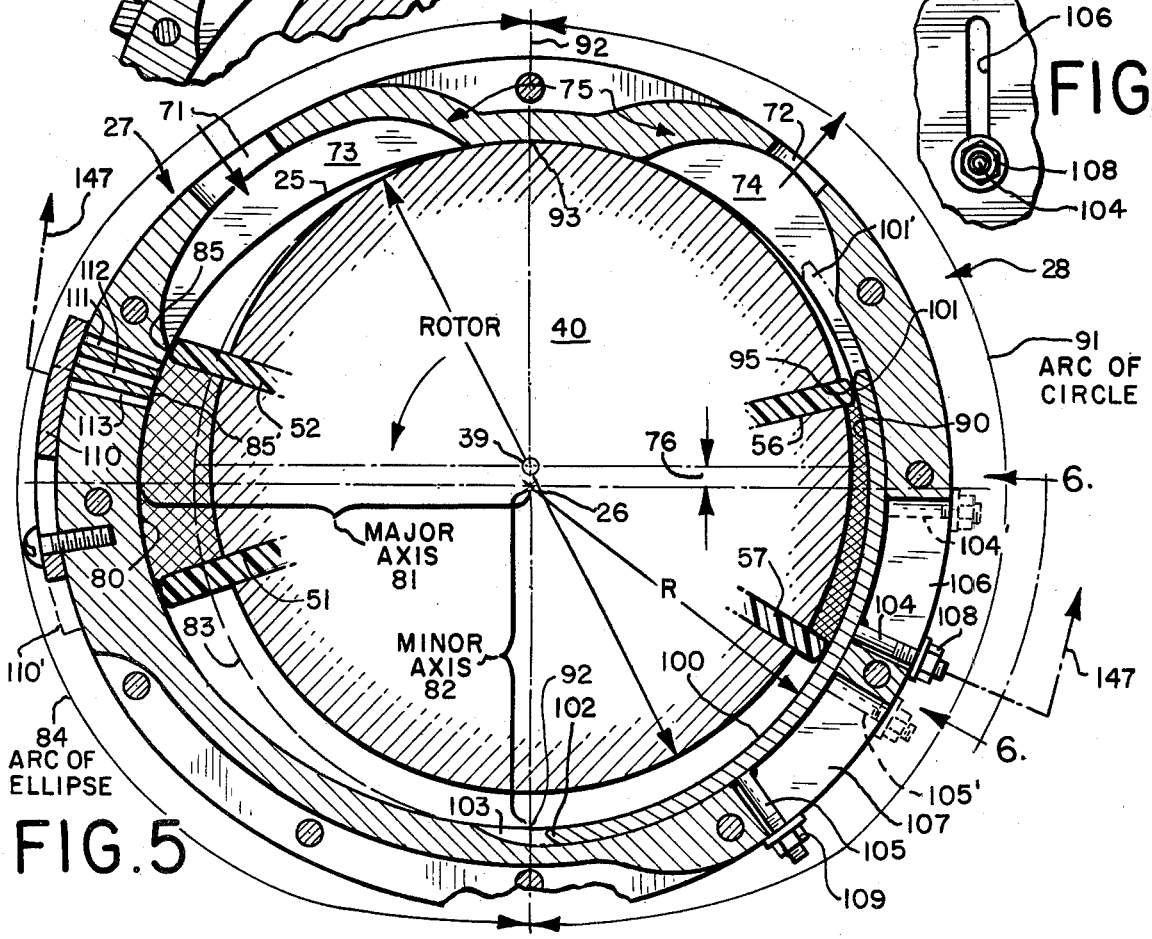
FIG. 5

VANE TYPE COMPRESSOR EMPLOYING ELLIPTICAL-CIRCULAR PROFILE

Rotary compressors are known in which a cylindrical rotor carrying radial vanes is mounted in a cylindrical chamber with the axis of the rotor offset from the axis of the chamber to provide compartments which are of reduced volume as the rotor rotates so that gas taken in at an inlet port is discharged under pressure at an outlet port. The active arc of compression in such devices is customarily less than 180 degrees.

A second type of compressor is known as exemplified by Edwards U.S. Pat. No. 4,088,426 in which the wall of the chamber is fully elliptical and in which the arc of compression is on the order of 90 degrees or less.

It is the primary object of the present invention to provide a compressor of the radial vane type in which the chamber in which the rotor operates has an inlet side which is of substantially elliptical profile and an outlet side which is of substantially circular profile, the two portions being smoothly continuous to provide an active arc of compression which may exceed 180 degrees.

It is a related object to provide a compressor of the rotary vane type which can be operated at a high pressure ratio with a high through-put, that is, mass per unit time, of the compressed gas.

It is an object of the invention to provide a compressor of the radial type which not only has a large arc of compression but in which the compression occurs uniformly and smoothly throughout the arc. By choosing an elliptical profile having a sufficient degree of eccentricity, an initially high volumetric ratio of compression is achieved while the gas is cool and at low pressure, and by employing a circular profile on the outlet side a low convergence or "ramp" angle is produced enabling final compression of the heated gas to high pressure at relatively high mechanical advantage. This distributes the torque load more or less evenly throughout the entire arc of compression. In this connection it is an object to provide a compressor of the radial vane type in which compression to high pressure occurs so evenly and progressively as to reduce peak bearing loads as well as vane and other types of friction.

It is another object to provide a high pressure compressor of the vane type in which there is a low pressure differential across individual vanes thereby minimizing leakage and bringing about a high degree of volumetric efficiency.

It is yet another object of the invention to provide a radial vane compressor in which the particular geometry permits large port flow areas thereby bringing about high flow efficiency, with the gas being aspirated and discharged with a minimum amount of wire drawing or turbulence.

It is still another object of the invention to provide a rotary vane compressor which can be efficiently constructed using a minimum number of vanes for example six vanes, while preserving a large port area and reducing energy dissipated in vane friction.

It is still another object of the invention to provide a compressor of the radial vane type in which the vanes are maintained in the extended position solely by means of centrifugal force and which permits operation, without loss of vane engagement, at extremely low speeds. This feature is of particular advantage when the device is used in an automotive air conditioner where air conditioning is required even under conditions where the engine may be rotating at a slow idle speed.

It is an object of the invention in one of its aspects to provide a compressor of the radial vane type in which the pressure ratio may be changed conveniently and on an infinitely variable basis. This is accomplished by the motion of a sliding "shoe" or liner adjacent the output port and which is moved arcuately along the cylindrical surface to vary the effective position of the outlet port. It is therefore an object to provide a compressor of the radial vane type which is especially desirable for use in an air conditioning system with movement of the liner being utilized to bring about a corrective adjustment in the heat rate of the system.

It is a general object of the present invention to provide a compressor of the radial vane type which overcomes the disadvantages of the two configurations of prior art compressors alluded to above but which can be economically manufactured, particularly for automotive usage, and which provides reliable service, without necessity for maintenance, for long periods of time.

Other objects and advantages of the invention will become apparent upon reading the attached detailed description and upon reference to the drawings in which:

FIG. 3 shows a typical vane and its supporting rollers in perspective.

FIG. 4 is a fragment showing vane clearance and based on FIG. 2.

FIG. 5 is a transaxial section taken along line 5—5 in FIG. 2 but diagrammatic to show the geometry of the construction as well as means at the outlet and inlet ports for varying the pressure ratio.

FIG. 6 is a fragment showing the pressure adjusting means as viewed along line 6—6 in FIG. 5.

FIG. 7 is a fragment showing use of a shiftable throttling plate or shutter at the inlet port to control the mass of gas entering each compartment.

FIG. 8 is a schematic diagram of a refrigeration system employing the present compressor with thermostatic control of the temperature.

While the invention has been described in connection with a preferred embodiment, it will be understood that we do not intend to be limited to the particular embodiment shown but intend, on the contrary, to cover the various alternative and equivalent forms of the invention included within the spirit and scope of the appended claims.

Figure 2:
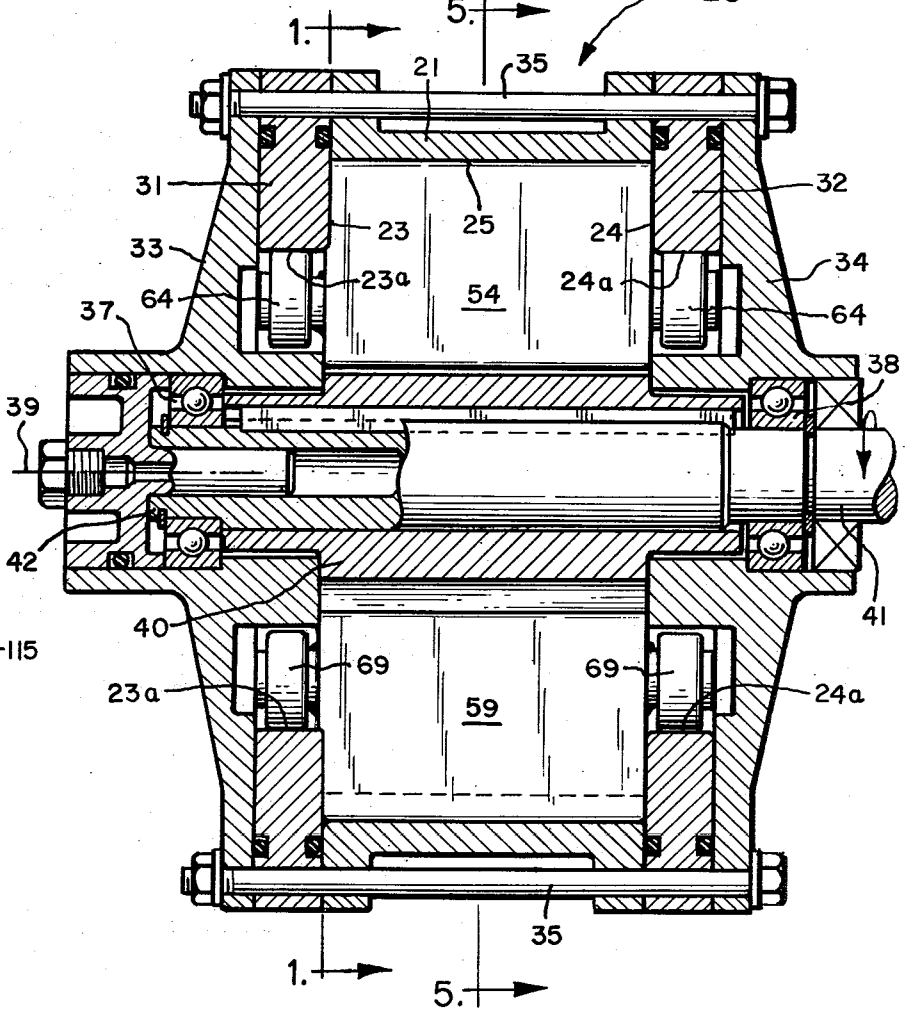
FIG. 2 is a section parallel to the axis as viewed along line 2—2 in FIG. 1.
Figure 1:
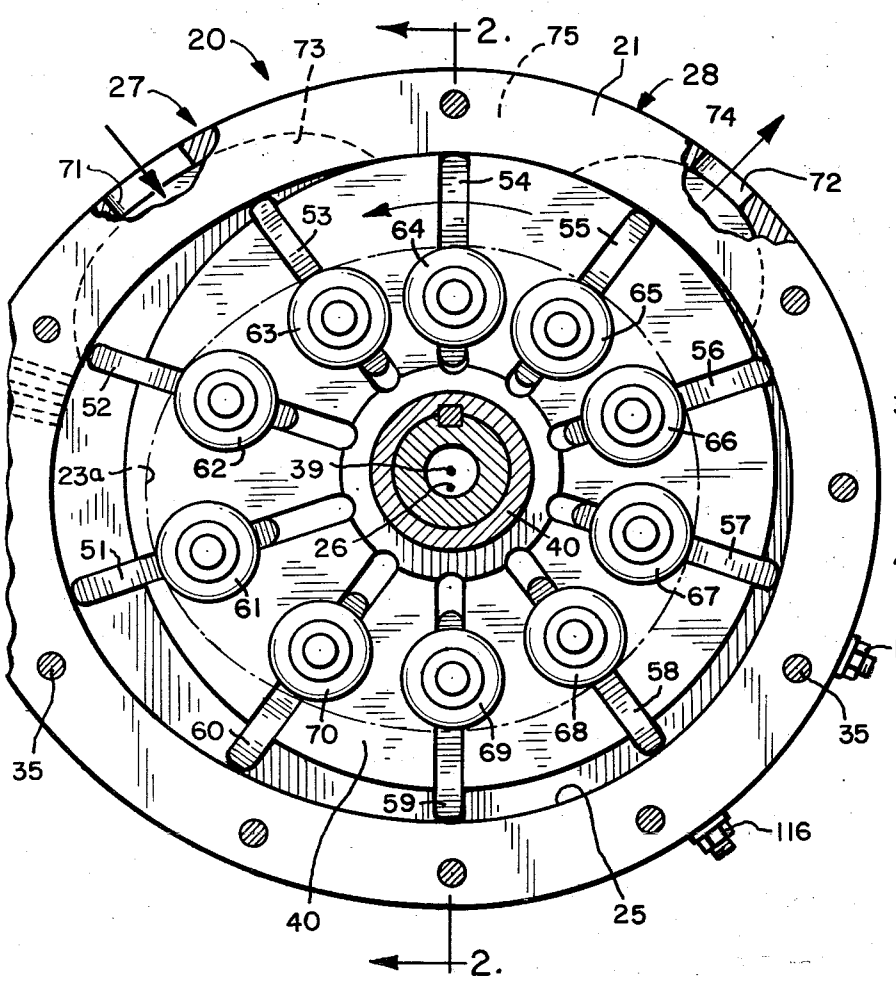
FIG. 1 is a vertical, transaxial section of the compressor constructed in accordance with the present invention as viewed along section line 1—1 in FIG. 2.

Turning now to the drawings there is disclosed in FIGS. 1 and 2 a compressor 20 comprising a housing 21 defining a chamber having opposed parallel end walls 23, 24 and a curved smoothly continuous outer wall 25 centered about a chamber axis 26. For convenience the chamber will be divided into an "inlet" or left-hand side 27 and an "outlet" or right-hand side 28.

Forming the end walls 23, 24 of the chamber are end plates 31, 32 which are respectively mounted upon end bells 33, 34 which are clamped together by means of clamping screws 35. The end bells carry anti-friction bearings 37, 38 and associated seals centered about a rotor axis 39.

The bearings 37, 38 serve to journal a rotor 40 of cylindrical shape supported upon a shaft having a driving end 41 and a remote end 42 respectively journaled in the bearings. The rotor, dimensioned to fit between the end walls, has a plurality of equally spaced radial grooves formed therein. Occupying the grooves for sliding movement in the radial direction are a set of vanes 51–60 which are of rectangular shape profiled to fit the chamber to define enclosed compartments between them.

Each vane (see FIG. 3) has a pair of axially extending stubshafts having rollers mounted thereon. The rollers, indicated at 61–70, are guided by roller tracks 23*a*, 24*a* formed in the end plates 31, 32 the tracks being so profiled that when the vanes are urged outwardly by centrifugal force the outer edges of the vanes follow in closely spaced proximity the outer wall 25 of the chamber (FIG. 4).

There is provided, on the inlet side 27 of the chamber, an inlet port 71 for aspiration of gas into each compartment between adjacent vanes. On the outlet side 28 there is provided an outlet port 72 for discharging gas from each compartment in the compressed state. The curved inner wall 25 is internally grooved to provide peripheral pockets 73, 74, respectively, which extend the ports so that they closely straddle a reference region 75 at the top of the housing. The rotor has its axis 39 offset laterally (upwardly) from the chamber axis 26 by an amount 76 so as to produce engagement of the rotor at the reference region to provide sealing between the ports.

In accordance with the present invention, in addition to the shaft axis being laterally offset, the curved wall of the chamber on the inlet side is of substantially elliptical profile with the major axis of the ellipse generally centered on the inlet side and with the inlet port extending to a point of cut-off short of the major axis while the curved wall on the outlet side is substantially circular in profile so that gas entering the inlet port is charged in a compartment between a pair of vanes as the major elliptical axis and progressively compressed over an arc of compression greater than about 180 degrees. Thus referring to FIG. 5, the elliptically profiled portion of the inner wall 25, and which is indicated at 80, is the path of an ellipse centered at axis 26 and having a major axis 81 and a minor axis 82. The degree of eccentricity of the ellipse can be gauged by comparing it to a circle 83. The ellipse occupies an arc 84 of 180 degrees.

It will be noted that the inlet port 73 extends counterclockwise to a point of cut-off 85 which is upstream of, that is, "short" of the major axis 81.

The curved wall 90 on the output side 28 is, in contrast, of circular profile centered at the chamber axis 26 and having an arcuate length 91 of 180 degrees, the curved surfaces 80, 90 merging smoothly at the points of transition 92, 93, respectively. The outlet port 72 extends from the reference region 75 to a point 95 of initial discharge, or drop-off, spaced angularly in the upstream (clockwise) direction.

In operation, passage of the first vane 51 past the point of cut-off 85 aspirates gas through the inlet port 71, with such aspiration continuing until the following vane 52 strikes the point of cut-off trapping the gas in the compartment represented by the cross hatched area. As the rotor rotates in the counterclockwise direction, the vanes 51, 52 defining the compartment are crowded radially inwardly, progressively reducing the volume of the gas to a degree which depends upon the eccentricity of the ellipse. After the vanes 51, 52 pass the point of transition 92 they engage the wall 90 which is of circular profile. While the rotor surface is also of circular profile the offset 76 between the two axes results in a shallow ramping of the vanes so that they are crowded inwardly at an extremely gradual rate until the volume is reduced to the amount indicated by the cross hatching on the right-hand side of the figure.

The use of the combined elliptical-circular profile causes volumetric compression at a rather rapid rate at the beginning while the gas is still relatively cool and at low pressure and volumetric compression at a more gradual rate after the gas is heated and at high pressure, with the total compression being extended over an arc on the order of 180 degrees or more as contrasted with the shorter arcs of compression in vane type compressors of more conventional design. The result is a compression cycle which is smoothly continuous and free of the peaks of torque encountered in conventional devices.

When the "leading" vane of a compartment, in the present instance as indicated at 56, encounters the point of initial discharge 95, the gas is progressively discharged under pressure into the outlet port 72.

In accordance with one of the features of the present invention an arcuate liner is mounted in the outlet side of the chamber, the trailing end of which defines the point of initial discharge, and means are provided for arcuately shifting the liner to vary the pressure at which the gas is discharged and therefore the compression ratio of the compressor. Thus we provide a liner, or shoe, 100 which is curved to lie in a circular profile and which has a downstream or trailing end 101 and an upstream or leading end 102. The trailing end 101 defines the point of initial discharge, previously indicated at 95. The liner 100 is dimensioned to extend axially all of the way between the parallel side walls 23, 24 of the chamber. It is recessed in a mating groove 103 having a radial depth which is precisely equal to the radial thickness of the liner so that the arcuate working surface 90, of circular profile, is accurately preserved.

In accordance with a further feature of the invention means are provided for arcuately shifting the liner to vary the point 95 at which initial discharge, into the outlet port, takes place. For this purpose the liner 100 is arcuately slidable in the groove 103. To position the liner 100 and to keep it firmly seated in its groove, the liner is fitted with a pair of outwardly extending studs 104, 105 which extend through respective adjustment slots 106, 107 The studs are fixed to the liner 100 in any desired way, for example by butt welding at the inner end and are preferably threaded at their outer ends for reception of nuts 108, 109. The degree of adjustment is determined by the peripheral length of the slots 106, 107 permitting the trailing end of the liner to occupy the dotdash position 101′ in which the studs occupy the positions 104′, 105′, with any intermediate point of adjustment being infinitely available between the two extremes. It will suffice to say that when the liner occupies a position 101′ the gas confined in the compartment between adjacent vanes is compressed more compactly resulting in a higher maximum pressure being reached before the gas is discharged into the outlet port, thereby increasing the compression ratio.

While it is preferred to vary the compression ratio by varying the position of the liner which in turn varies the point of initial discharge, means may be provided at the inlet port 71 for controlling the mass of gas aspirated into each compartment for thereby determining the compression ratio of the compressor. The aspirated mass can be determined in two ways, the first by varying the point of cut-off 85 and the second by throttling. The means for varying the point of cut-off is shown in FIG. 5 where it will be noted that a shutter plate 110 is provided covering a series of auxiliary openings 111, 112, and 113. With all of the auxiliary openings covered by the shutter, the point 85, previously referred to, defines cut-off. However, when the shutter is moved to the dot-dashed position 110', uncovering the auxiliary openings 111, 112, the effective point of cut-off is moved downstream to a new position 85' which corresponds to a reduced initial volume of the compartment. In short, with the openings 111, 112 uncovered a lesser mass of gas is taken in before the compartment is finally sealed off. Since a lesser mass of gas is acted upon during the compression cycle, the pressure of the gas discharged into the outlet port will be correspondingly reduced resulting in a reduction in the compression ratio of the compressor.

To utilize throttling effect to bring about a reduction in the mass of gas charged into a compartment, reference is made to FIG. 7 which shows a shutter plate 120 which is peripherally shiftable and which has an opening 121 which normally registers with the inlet port 71 but which may be offset with respect thereto for reducing the effective size of the inlet port. The throttling which takes place during the aspiration results in a pressure differential so that the initial pressure of the gas in the enclosed compartment is less than the pressure of the supply, resulting in a smaller mass of gas being captured. Such smaller mass of gas, as in the case where shutter plate 110 is used, produces a correspondingly reduced pressure at the outlet port.

Not only does the elliptical-circular configuration provide achievement of high compression with the compressive torque distributed throughout a long arc, but the configuration has been found to have numerous additional advantages. The pressure differential across individual vanes is relatively low to minimize linkage and to bring about a high degree of volumetric efficiency. Large volumes of gas per unit time may be handled through port areas which are relatively large to bring about high flow efficiency.

While the invention has been described in connection with a structure employing ten vanes, the advantages of the construction may be achieved with a lesser number of vanes for example six; one advantage, in addition to economy, is to reduce the amount of energy dissipated in vane friction.

It is also one of the features that "jump" speed is reduced. "Jump" speed is the speed at which, upon a reduction of speed and consequent reduction in centrifugal force, the vane during its inward radial movement develops sufficient momentum so that it tends to overtravel in the inward direction. In short, the inward accelerational force of the vane, as the vane encounters a portion of the wall which is of reduced radius, may exceed the centrifugal force which holds the vane outwardly in engagement with the wall of the chamber so that the outer edge of the vane actually leaves the chamber wall. This is highly disadvantageous, even though the action is only momentary, since it results in gross leakage of gas around the vane and in addition produces a high level of noise and vibration. The present construction does not suffer from this problem because it suffices to use an elliptical profile which is of relatively limited eccentricity, an eccentricity which may range between 15° and 35° and which results in relatively shallow "ramp" angles and relatively low levels of inwardly directed accelerational forces. As a result, in the present construction, it is possible to achieve normal compression ratios even at low driving speeds, speeds which correspond, for example, to the idling speed of an automobile engine. This makes the construction particularly advantageous when used in automotive air conditioning.

While the compressor may be used universally wherever compression of a gas is required, it will be helpful to give consideration to a typical use of the compressor in a thermostatically controlled automobile air conditioning system as set forth in FIG. 8. Here the compressor indicated at 20 is shown using a suitable refrigerant and connected to an automobile engine E. A primary heat exchanger 130 is connected to the outlet port 72 for receiving and cooling the compressed gas so that it is condensed into the liquid state. A secondary heat exchanger 131 is connected to the inlet port 71 of the compressor. A resistive or throttling device such as a capillary tube 132 is interposed between the two heat exchangers so that liquid refrigerant from the primary heat exchanger is fed at a lower pressure to the secondary heat exchanger where it is evaporated into the gaseous state accompanied by absorption of heat. Where the system is to be employed for automotive cooling purposes the secondary heat exchanger 131 is located in the passenger space within the automobile.

For automatically controlling the temperature within the passenger space a thermostatic element 140 is employed, shown here in the form of a simple bi-metal and cooperating with alternate contacts 141, 142. The contacts are connected to forward and reverse terminals F and R of a small auxiliary servo motor 143. The contacts 141, 142 are jointly movable, for example by mounting upon an arm 144 having a mechanical connection 145 with the servo motor. A similar mechanical connection 147 couples the servo motor to an element of the compressor 20 which is mechanically variable to control the pressure ratio of the compressor and hence the heat rate of the system. Thus the connection 147 may be made to the liner 100 or to the shutter plates 110 or 120. It will be assumed in the present instance that a mechanical connection is made to the liner as being a preferred embodiment of the invention. The power for driving the servo motor 143 may be provided by the automotive battery indicated at B.

In a typical cycle of operation of the refrigeration system it will be assumed that the system is in equilibrium with the bi-metal not making contact with either of the contacts 141, 142. If the equilibrium is upset by opening the doors of the automobile resulting in entry of warm air the bi-metal bends toward contact 141, with the making of electrical contact feeding current from the battery into the forward terminal F of the motor. Rotation of the motor has two effects. In the first place it results in movement of the mechanical connection 147 to move the liner 100 (FIG. 5) in the counterclockwise direction, delaying initial discharge of the compressed gas and increasing the output pressure which increases the heat rate so that heat is absorbed at the secondary heat exchanger at a faster rate. This makes up for loss of "cold" to the outside ambient and reestablishes equilibrium. Secondly, movement of the thermostat contacts, brought about by the mechanical connection 145, disengages the contact 141 from the thermostatic element 140 to turn off the servo motor to prevent overshoot.

Should the temperature in the controlled space become lower than the set value, as may be brought about, for example, by a drop in ambient temperature, the control sequence takes place in the opposite direction. That is, the contact 142 is "made" energizing the reverse terminal of the servo motor to move the liner 100 in the opposite (upstream) direction to provide a reduction in compression ratio and a reduction in heat rate so that heat is absorbed in the space by the primary heat exchanger at a lesser rate until equilibrium at the set temperature is again achieved.

The described compressor, in use in an air conditioning system or for any other purpose, may be economically constructed and operated for long periods of time without any more than casual maintenance. Operation is smooth even when developing high pressure and without peak load forces which tend to reduce bearing life. Compression ratio, and hence heat rate, can be quickly varied by moving the liner or shutter plate through a short displacement while preserving efficiency over a wide range of adjustment.

While the invention in its preferred form employs a true ellipse and true circle in combination with one another, it will be understood that the invention is not limited thereto and can be practiced employing surfaces which are substantially elliptical and substantially circular, with the distinguishing feature of the invention being compression over an angle of more than about 180 degrees.

Finally, while auxiliary openings 111–113 have been shown (FIG. 5) at the periphery of the housing for varying the point of cut-off of the aspirated gas, it will be understood that this has been shown to illustrate the principle involved and that such openings are more suitably included in the side walls 23, 24 where the surface is flat and in area engagement with the presented lateral edges of the vanes, thereby to minimize leakage around the vanes.

What we claim is:

1. A rotary compressor comprising in combination a housing defining a chamber having opposed parallel end walls and a curved smoothly continuous outer wall centered about a chamber axis, the outer wall having a reference region defining inlet and outlet sides of the chamber, a rotor of cylindrical shape having a plurality of equally spaced radial grooves formed therein and having a shaft for supporting the same for rotation in the housing, vanes profiled to fit the chamber and radially slidable in the grooves to define enclosed compartments between them, each vane having a pair of axially extending stubshafts having rollers respectively mounted thereon, roller tracks formed in the end walls of the chamber for accommodating the rollers and for guiding the vanes so that the outer edges of the vanes follow in closely spaced proximity the outer wall of the chamber, means defining an inlet port on the inlet side of the chamber for aspiration of gas into a compartment and an outlet port on the outlet side for discharging gas from the compartment in the compressed state, the ports being positioned to closely straddle the reference region, the rotor having its axis laterally offset from the chamber axis so as to produce engagement of the rotor at the reference region for sealing between the ports, the curved wall of the chamber on the inlet side being of substantially elliptical profile with the major axis of the ellipse generally centered on the inlet side and with the inlet port extending to a point of cut-off short of the major axis while the curved wall on the outlet side is substantially circular in profile so that gas entering the inlet port is charged in a compartment between a pair of vanes at the major elliptical axis and progressively compressed over an arc of compression greater than about 180 degrees.

2. The combination as claimed in claim 1 in which the outlet port extends from the reference region to a point of initial discharge angularly spaced upstream therefrom, an arcuate liner mounted in the outlet side of the chamber the trailing end of which defines the point of initial discharge, and means for peripherally shifting the liner to vary the pressure at which the gas is initially discharged and therefore the compression ratio of the compressor.

3. The combination as claimed in claim 2 in which the gas is a refrigerant capable of liquifaction under pressure, a primary heat exchanger connected to the outlet port for receiving and cooling the compressed gas so that it is condensed into the liquid state, a secondary heat exchanger connected to the inlet port of the compressor, throttling means interposed between the two heat exchangers so that liquid refrigerant from the primary heat exchanger is fed at a lower pressure to the secondary heat exchanger where it is evaporated into the gaseous state accompanied by absorption of heat, one of the heat exchangers being thermally coupled to a controlled space, a thermostat in the controlled space, and means responsive to the thermostat and mechanically coupled to the liner shifting means for correctively varying the pressure ratio of the compressor to bring about a change in heat rate for maintaining a constant temperature condition in the controlled space.

4. The combination as claimed in claim 1 in which means are provided at the inlet port for controlling the mass of gas aspirated into each compartment and therefore the compression ratio of the compressor.

5. The combination as claimed in claim 4 in which the gas is a refrigerant capable of liquifaction under pressure, a primary heat exchanger connected to the outlet port for receiving and cooling the compressed gas so that it is condensed into the liquid state, a secondary heat exchanger connected to the inlet port of the compressor, throttling means interposed between the two heat exchangers so that liquid refrigerant from the primary heat exchanger is fed at a lower pressure to the secondary heat exchanger where it is evaporated into the gaseous state accompanied by absorption of heat, one of the heat exchangers being thermally coupled to a controlled space, a thermostat in the controlled space, and means responsive to the thermostat and mechanically coupled to the mass controlling means for correctively varying the pressure ratio of the compressor to bring about a change in heat rate for maintaining a constant temperature condition in the controlled space.

* * * * *